US011247832B2

(12) United States Patent
Rehders et al.

(10) Patent No.: US 11,247,832 B2
(45) Date of Patent: Feb. 15, 2022

(54) TRAY FOR AN ELECTRONIC SMOKING DEVICE OR PARTS THEREOF

(71) Applicant: Fontem Holdings 1 B.V., Amsterdam (NL)

(72) Inventors: Thorben Rehders, Hamburg (DE); Sebastian Senftleben, Hamburg (DE); Duncan B. Robinson, Chesterfield (GB)

(73) Assignee: Fontem Holdings 1 B.V., Amsterdam (NL)

( * ) Notice: Subject to any disclaimer, the term of this patent is extended or adjusted under 35 U.S.C. 154(b) by 0 days.

(21) Appl. No.: 17/098,163

(22) Filed: Nov. 13, 2020

(65) Prior Publication Data

US 2021/0130069 A1 May 6, 2021

Related U.S. Application Data

(63) Continuation of application No. 15/759,393, filed as application No. PCT/EP2016/071977 on Sep. 16, 2016, now Pat. No. 10,865,030.

(30) Foreign Application Priority Data

Sep. 18, 2015 (EP) ..... 15185882

(51) Int. Cl.
*B65D 81/113* (2006.01)
*B65D 85/10* (2006.01)
(Continued)

(52) U.S. Cl.
CPC ..... *B65D 81/113* (2013.01); *A24F 15/00* (2013.01); *A24F 15/01* (2020.01); *A24F 40/40* (2020.01);
(Continued)

(58) Field of Classification Search
CPC .. B65D 81/113; B65D 85/10; B65D 2215/02; B65D 2215/06; A24F 15/00; A24F 47/008
(Continued)

(56) References Cited

U.S. PATENT DOCUMENTS 565,710 A 8/1896 Tollner
3,126,891 A 3/1964 Caputi
(Continued)

FOREIGN PATENT DOCUMENTS

FR 2845669 A1 4/2004
GB 2422368 A 7/2006
WO 2012053964 A1 4/2012

*Primary Examiner* — Ernesto A Grano
(74) *Attorney, Agent, or Firm* — Dykema Gossett PLLC

(57) ABSTRACT

The present invention relates generally to electronic smoking devices and in particular to a tray for at least a portion of an electronic smoking device.

The tray (100) comprises at least one cavity (101) for containing the portion. The tray (100) is configured to be reversibly deformed from a default form into a deformed form by finger interaction with interaction elements of the tray (100) having a distance to each other of at least 90% of the average distance between thumb tip and index finger tip or a middle finger tip of an adult. The tray (100) is configured to return to the default form once the finger interaction is terminated. The default form provides the at least one cavity (101) for containing the portion in an inaccessible manner and the deformed form is required for accessing the portion.

15 Claims, 9 Drawing Sheets

(51) Int. Cl.
*A24F 40/40* (2020.01)
*A24F 15/01* (2020.01)
*A24F 15/00* (2020.01)

(52) U.S. Cl.
CPC ..... *B65D 85/10* (2013.01); *B65D 2215/02* (2013.01); *B65D 2215/06* (2013.01)

(58) Field of Classification Search
USPC ..... 206/242
See application file for complete search history.

(56) References Cited

U.S. PATENT DOCUMENTS

| | | | |
|---|---|---|---|
| 3,703,975 | A | 11/1972 | Wittemer |
| 4,480,762 | A | 11/1984 | Thomas |
| 4,669,617 | A | 6/1987 | Boecknnann |
| 5,495,938 | A | 3/1996 | Bedford |
| 5,788,064 | A | 8/1998 | Sacherer |
| 5,819,942 | A | 10/1998 | Sadow |
| 6,029,816 | A | 2/2000 | Goodwin |
| 6,047,826 | A | 4/2000 | Kalinski |
| 6,196,388 | B1 | 3/2001 | Kaposvari |
| 6,681,933 | B1 | 1/2004 | Demsien |
| 6,915,901 | B2 | 7/2005 | Feinberg |
| D514,805 | S | 2/2006 | Owen |
| 7,441,655 | B1 | 10/2008 | Hoffman |
| D648,630 | S | 11/2011 | Doster |
| 8,727,117 | B2 | 5/2014 | Maasarani |
| 9,630,745 | B2 | 4/2017 | Lepot |
| 10,028,798 | B1 | 7/2018 | Healey |
| D849,539 | S | 5/2019 | Watson |
| D856,147 | S | 8/2019 | Anderson |
| 2012/0302947 | A1 | 11/2012 | Canton |
| 2013/0064733 | A1 | 3/2013 | Gerstner |
| 2013/0140201 | A1 | 6/2013 | Ghini |
| 2014/0097113 | A1 | 4/2014 | Babineau |
| 2014/0260406 | A1 | 9/2014 | Tenbarge |
| 2015/0068942 | A1 | 3/2015 | Gerstner |
| 2017/0119044 | A1 | 5/2017 | Oligschlaeger |
| 2017/0224435 | A1 | 8/2017 | Godfrey |
| 2018/0283759 | A1 | 10/2018 | Bess |
| 2019/0184907 | A1 | 6/2019 | Weintraub |
| 2019/0337689 | A1 | 11/2019 | Mazurek |

TRAY FOR AN ELECTRONIC SMOKING DEVICE OR PARTS THEREOF

CROSS-REFERENCE TO RELATED APPLICATIONS

This application is a continuation of U.S. application Ser. No. 15/759,393, filed 12 Mar. 2018 (the '393 application), now U.S. Pat. No. 10,865,030, which is the national stage of international application no. PCT/EP2016/071977, filed 16 Sep. 2016 (the '977 application), and published under International publication no. WO 2017/046334 on 23 Mar. 2017. This application claims priority to European application no. 15185882.6, filed 18 Sep. 2015 (the '882 application). The '393 application, the '977 application and the '882 application are all hereby incorporated by reference in their entirety as though fully set forth herein.

FIELD OF INVENTION

The present invention relates generally to electronic smoking devices and in particular to a tray for at least a portion of an electronic smoking device.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

Since portions used in electronic smoking devices such as a liquid reservoir are potentially harmful if used inappropriately, e.g. by children, said portions of electronic smoking devices need to be contained in a child-safe manner.

SUMMARY OF THE INVENTION

In accordance with one aspect of the present invention, a tray is provided for containing at least a portion of an electronic smoking device in a child-safe manner.

The tray comprises at least one cavity for containing the portion. The tray is configured to be reversibly deformed from a default form (also referred to as undeformed shape) into a deformed form (also referred to as deformed shape) by finger interaction of at least two separate fingers of a user with interaction elements of the tray having a distance to each other of at least 90% of the average distance between thumb tip and index finger tip or a middle finger tip of an adult. The tray is configured to return to the default form once the finger interaction is terminated. The default form provides the at least one cavity for containing the portion in an inaccessible manner and the deformed form is required for accessing the portion.

The characteristics, features and advantages of this invention and the manner in which they are obtained as described above will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
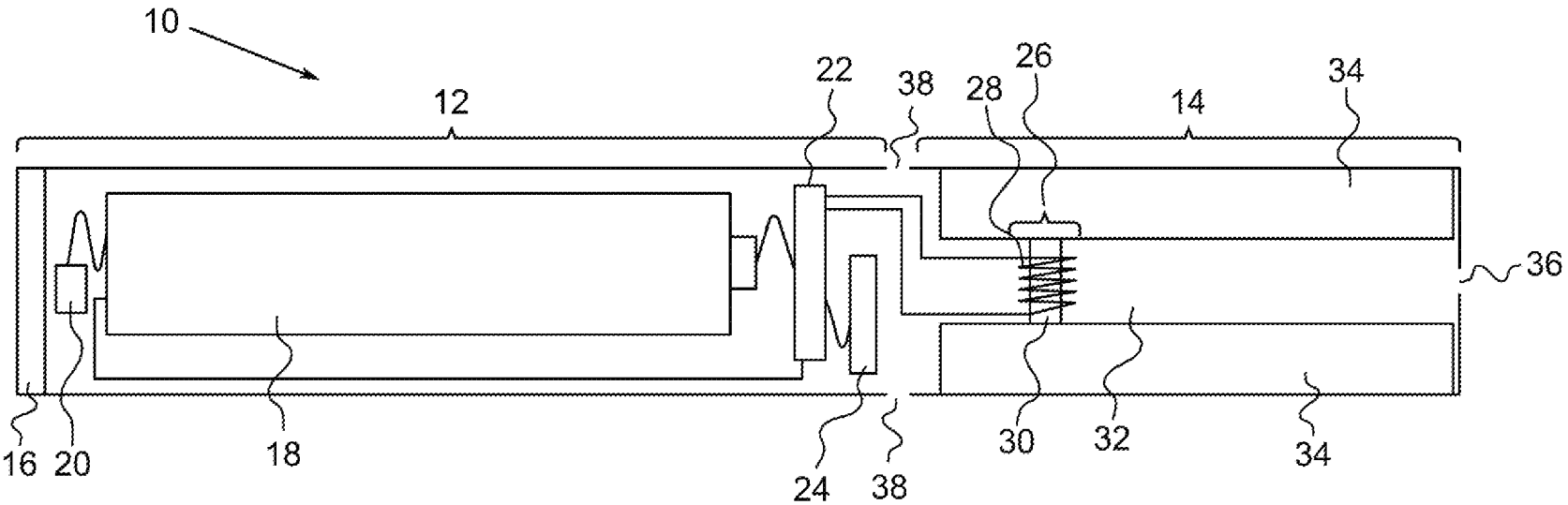
FIG. 1 is a schematic cross-sectional illustration of an exemplary e-cigarette.

Throughout the following, an electronic smoking device will be exemplarily described with reference to an e-cigarette. As is shown in FIG. 1, an e-cigarette 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a battery portion 12 and an atomizer/liquid reservoir portion 14. Together the battery portion 12 and the atomizer/liquid reservoir portion 14 form a cylindrical tube which can be approximately the same size and shape as a conventional cigarette, typically about 100 mm with a 7.5 mm diameter, although lengths may range from 70 to 150 or 180 mm, and diameters from 5 to 20 mm.

The battery portion 12 and atomizer/liquid reservoir portion 14 are typically made of metal, e.g. steel or aluminum, or of hardwearing plastic and act together with the end cap 16 to provide a housing to contain the components of the e-cigarette 10. The battery portion 12 and an atomizer/liquid reservoir portion 14 may be configured to fit together by a friction push fit, a snap fit, or a bayonet attachment, magnetic fit, or screw threads. The end cap 16 is provided at the front end of the battery portion 12. The end cap 16 may be made from translucent plastic or other translucent material to allow a light-emitting diode (LED) 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, or at the connection of the battery portion 12 and the atomizer/liquid reservoir portion 14. FIG. 1 shows a pair of air inlets 38 provided at the intersection between the battery portion 12 and the atomizer/liquid reservoir portion 14.

A battery 18, an LED 20, control electronics 22 and optionally an airflow sensor 24 are provided within the cylindrical hollow tube battery portion 12. The battery 18 is electrically connected to the control electronics 22, which are electrically connected to the LED 20 and the airflow sensor 24. In this example the LED 20 is at the front end of the battery portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the e-cigarette 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending across a central passage 32 of the atomizer/liquid reservoir portion 14. The coil 28 may be positioned anywhere in the atomizer 26 and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or maybe formed in an end cap.

In use, a user sucks on the e-cigarette 10. This causes air to be drawn into the e-cigarette 10 via one or more air inlets, such as air inlets 38, and to be drawn through the central passage 32 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the central passage 32. As the user continues to suck on the e-cigarette 10, this aerosol is drawn through the central passage 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some e-cigarettes are intended to be disposable and the electric power in the battery 18 is intended to be sufficient to vaporize the liquid contained within the liquid reservoir 34, after which the e-cigarette 10 is thrown away. In other embodiments the battery 18 is rechargeable and the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the e-cigarette 10 is detachable from the battery portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer.

The new liquid reservoir 34 may be in the form of a cartridge having a central passage 32 through which a user inhales aerosol. In other embodiments, aerosol may flow around the exterior of the cartridge 32 to an air inhalation port 36.

Of course, in addition to the above description of the structure and function of a typical e-cigarette 10, variations also exist. For example, the LED 20 may be omitted. The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus, for example, the atomizer may have a heating coil in a cavity in the interior of a porous body soaked in liquid. In this design, aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Figure 2:
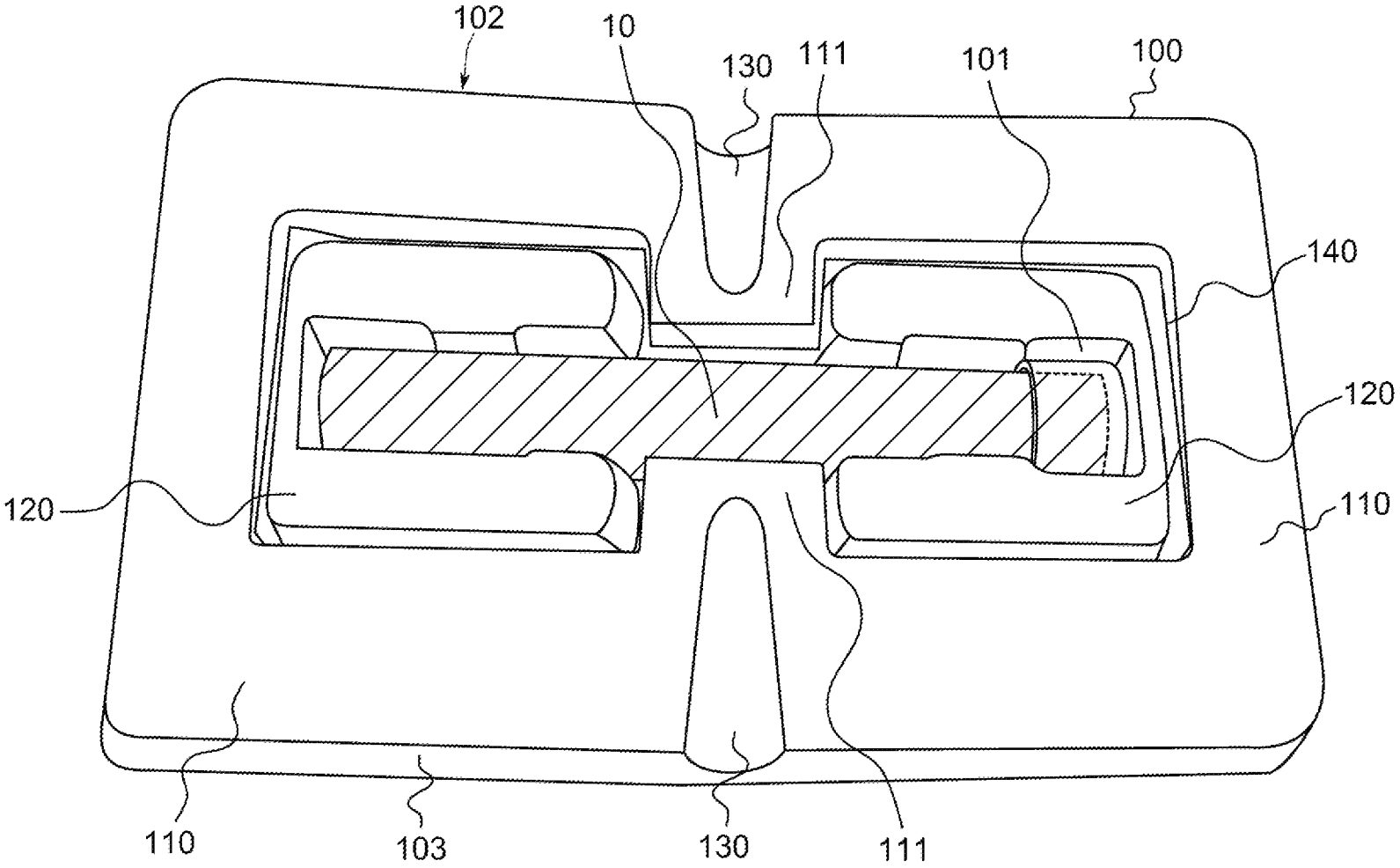
FIG. 2 is an exemplary depiction of a tray according to a first embodiment of the present invention.

FIG. 2 shows an exemplary depiction of a tray according to a first embodiment of the present invention. For containing such an electronic smoking device as disclosed by way of example in connection with FIG. 1 or parts (functional components) thereof, in a child-safe manner, i.e. inaccessible for a child, a first aspect of the invention concerns a tray for containing an electronic smoking device, e.g. an electronic cigarette. An example of a top surface of a tray 100 according said first aspect is depicted in FIG. 2 in its default form, i.e. in an undeformed shape when no external pressure is applied to the tray 100 except the (average) atmospheric pressure resulting from ambient air.

Essentially perpendicular to its upper surface, the tray 100 comprises two lateral surfaces being parallel to each other having a relatively longer distance to each other and two lateral surfaces 102, 103 being parallel to each other having a relatively shorter distance to each. These lateral surfaces 102, 103 have a width (distance between each other) perpendicular to the other lateral surfaces of at least 4.5 cm or more. According to embodiments of the present invention, said width (distance) between the lateral surfaces 102, 103 is greater than 5.0 cm, more preferably greater than 5.5 cm, more preferably greater than 6.0 cm, more preferably greater than 6.5 cm, more preferably greater than 7.0 cm, more preferably greater than 7.5 cm, more preferably greater than 8.0 cm and more preferably greater than 8.5 cm. In this sense, alternatively expressed, the shorter lateral surfaces have a width perpendicular to the longer lateral surfaces 102, 103 of at least 65% of the average distance between index finger tip or middle finger tip and thumb tip of an adult, more preferably of at least 65%, more preferably of at least 70%, more preferably of at least 75%, more preferably of at least 80%, more preferably of at least 85% and more preferably of at least 90%.

Accordingly, the separate lateral surfaces 102, 103 are spaced apart such that small children's hands are not able to press the two areas (lateral surfaces 102, 103) with the fingers of one hand at the same time. Even if a non-authorized user would press the lateral surfaces 102, 103 with different hands, the user would not be able to removed an electronic cigarette (or a part thereof) from the tray 100 because the unlocking mechanism (activated under sufficient pressure to the separate lateral surfaces 102, 103) is configured such that the electronic cigarette (or a part thereof) is only unlocked but not automatically ejected from the cavity 101 and accordingly another hand (not pressing the lateral surfaces 102, 103) is required to remove the unlocked electronic cigarette (or a part thereof) from the cavity 101 before releasing the pressure from the at least two interaction elements (lateral surfaces 102, 103).

The tray 100 comprises a (preferably deeply drawn) cavity 101 in which an exemplary elongated e-cigarette 10 is contained (or accommodated) with two ends extending parallel to the lateral surfaces 102, 103. The tray 100 comprises an outer portion 110 which surrounds two inner portions 120. There is a (deeply drawn) groove 140 located between the outer portion 110 and the inner portions 120. Each of the inner portions 120 surrounds one of the two ends in a manner that no finger can be put between the respective inner portion 120 and the respective end. Hence, the ends of the e-cigarette 10 cannot be accessed either by a child or by an adult without pressing the two interaction elements (lateral surfaces 102, 103).

In a remaining middle section of the e-cigarette 10, parts 111 of the outer portion 110 of the tray 100 surround the e-cigarette 10 directly without any of the inner portions 120 in between. The parts 111 surround the middle section in a manner that no finger can be put between the middle section and the outer portion 110. Hence, also the remaining middle portion of the e-cigarette 10 cannot be accessed either by a child or by an adult without pressing the two interaction elements (lateral surfaces 102, 103).

Thus, in a default form (undeformed shape), the tray 100 accommodates the e-cigarette 10 inaccessible by fingers of a user.

The tray 100 may be a plastic container, for example a thermoformed plastic container. In another exemplary and non-limiting embodiment the tray 100 is injection molded.

The outer portion 110 has (deeply drawn) indentations 130 extending from the lateral surfaces 102, 103 towards the middle section only separated therefrom by parts 110.

Figure 3:
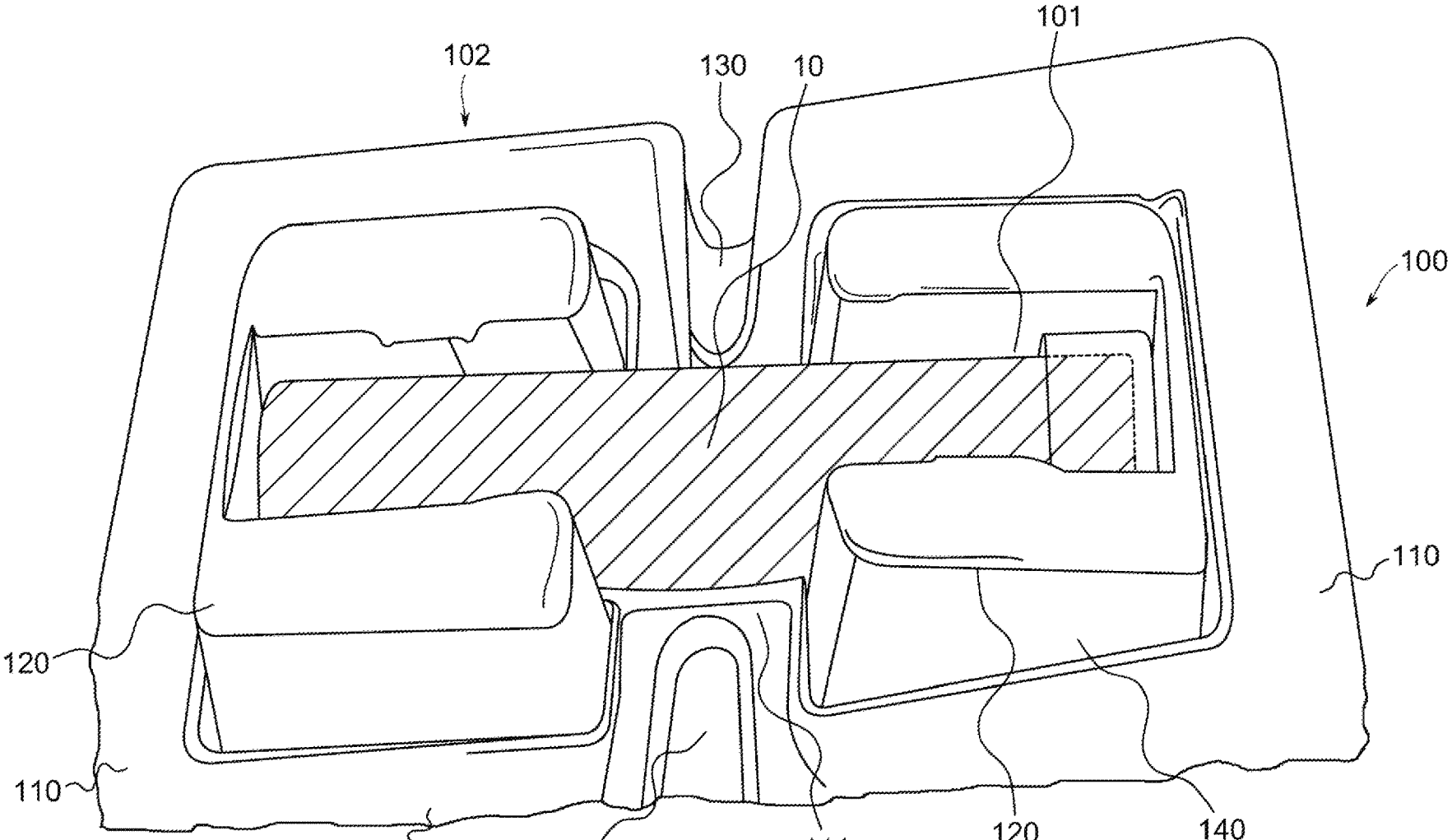
FIG. 3 is an exemplary depiction of the tray of FIG. 2 in deformed shape.

FIG. 3 shows the top surface of the tray 100 of FIG. 2 in deformed shape. The deformed shape can be achieved by pressure on the lateral surfaces 102, 103 of the tray 100, for example below the indentations 130 or laterally therefrom. Hence, for achieving deformation with a single hand, the hand span must be large enough as specified above. Otherwise, two hands are required for applying sufficient pressure on the longer lateral surfaces 102, 103 of the tray 100 such that the tray 100 becomes deformed. Once pressure is released, the tray 100 (preferably immediately) returns back into the undeformed shape, e.g. the tray 100 may snap back into the default shape. In an embodiment, deforming requires a pressure exceeding a predetermined pressure threshold. The pressure threshold may be predetermined such that it corresponds to 25% of the pressure an adult can apply on average with tips of the index finger or of the middle finger and of the thumb.

According to embodiments of the present invention, said predetermined pressure threshold may be such that it corresponds to 30%, more preferably of at least 35%, more preferably of at least 40%, more preferably of at least 45%, more preferably of at least 50%, more preferably of at least 55%, more preferably of at least 60%, more preferably of at least 65%, more preferably of at least 70%, more preferably of at least 75%, more preferably of at least 80%, more preferably of at least 85% and more preferably of at least 90% of the pressure an adult can apply in average with tips of the index finger or of the middle finger and of the thumb. In this sense, alternatively expressed, a force applied to tray 100 via the at least two interaction elements (lateral surfaces 102, 103) may be more than 0.1 N, more preferably more than 0.2 N, more preferably more than 0.4 N, more preferably more than 0.8 N, more preferably more than 1.6 N, more preferably more than 3.2 N and more preferably more than 5 N.

Simultaneous pressure on the lateral surfaces 102, 103 (or alternatively force on the tray 100 applied via lateral surfaces 102, 103) causes at least one of the inner portions 120 to be lifted with respect to the outer portion 110. Thereby, the e-cigarette 10 is lifted, at least partly, too. Particularly, the middle section of the e-cigarette 10 is lifted (but not completely ejected) at least partly above the part 111 of the outer portion. Thereby the middle section becomes accessible, i.e. it can be taken out with the fingers. However, when the e-cigarette 10 is not taken out and the pressure (or force) is removed, the e-cigarette 10 becomes inaccessible again, i.e. the e-cigarette 10 is locked again.

Thus, an adult capable of pressing the interaction elements (lateral surfaces 102, 103) with a single hand sufficiently strong can take out the e-cigarette with the fingers of the other hand while keeping the interaction elements (lateral surfaces 102, 103) pressed. In contrast, a child or teenager needs both hands for applying sufficient pressure (or force) and therefore cannot take out the e-cigarette 10.

Figure 4:
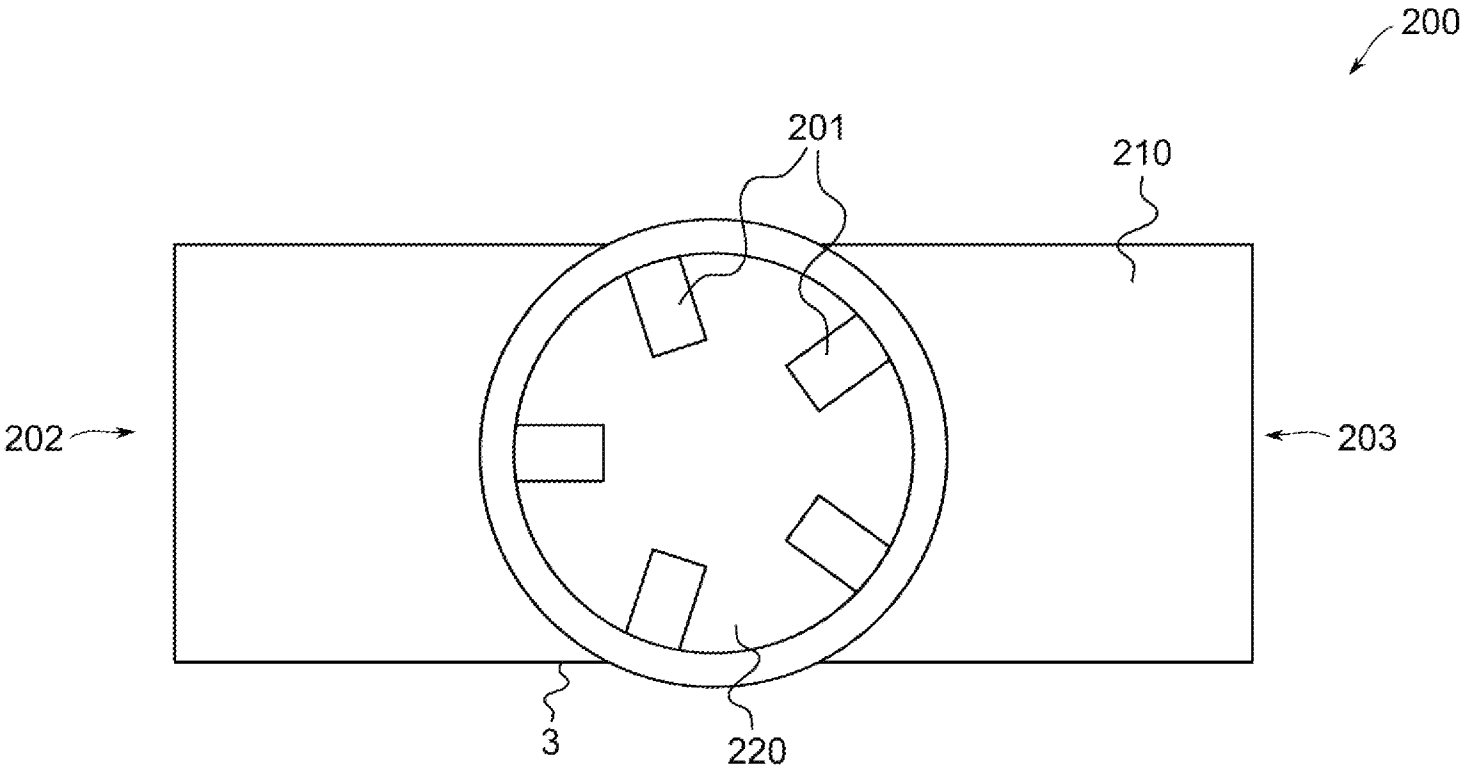
FIG. 4 is an exemplary depiction of a tray according to a second embodiment of the present invention.

FIG. 4 shows is an exemplary depiction of a tray 200 in an undeformed state (or shape or form) according to a second embodiment of the present invention.

The tray 200 depicted in FIG. 4 comprises cavities 201, each for containing a portion (i.e. functional component) of an electronic smoking device, e.g. cartomizers. In other exemplary embodiments, the cavities 201 can be configured for containing mouthpieces, atomizer/liquid portions and/or liquid reservoirs.

The cavities 201 are provided in a rotatable portion 220 which is rotatable around a normal of the top surface of the tray 200. The cavities 201 extend radially having openings at a cylindrical surface 214 of the rotating device 220. In the default form (undeformed state), the openings of the cavities 201 are at least partly covered by the outer portion 210. The tray 200 further comprises an outer portion 210. In a default form of the tray 200, the rotatable portion 220 is surrounded by the outer portion 210 such that the rotatable portion 220 is inaccessible for being rotated by hand. Alternatively or additionally, the rotatable portion 220 is blocked by the outer portion 210 from being rotated when the tray 200 is in its default form. Alternatively or additionally, the openings of the cavities 201 are at least partly covered by the outer portion 210 in the default form.

The tray 200 comprises, e.g. as part of the outer portion, lateral surfaces 202, 203 functioning as interaction elements and extending essentially perpendicular to the top surface. The separate lateral surfaces 202, 203 have a distance from each other as specified in connection with FIGS. 2 and 3.

Simultaneous pressure on the lateral surfaces 202, 303 causes the rotatable portion 220 to be lifted with respect to the outer portion 210 such that it becomes accessible for being rotated by hand and/or the blocking of the rotatable portion 220 by the outer portion to be released such that the rotatable portion 220 can be rotated. However, at least all but one opening of the cavities 201 remains at least partly covered by the outer portion 210 in the deformed state, too. Particularly all openings of the cavities 201 are partly covered by the lateral surface 205 even in the deformed state as long as the rotatable portion has not been rotated.

Therefore an adult (having a sufficiently large hand) capable of pressing said lateral surfaces with a single hand sufficiently strong can lift and/or release the rotatable portion 220 with the fingers of the one hand and use the other hand for simultaneously rotating the rotatable portion 220 in order to move the opening of one of the cavities to a position where its content can be accessed. But a child or teenager (having an insufficiently small hand) needs both hands for applying the pressure or for applying sufficient pressure and then cannot rotate the rotatable portion 220.

Figure 5:
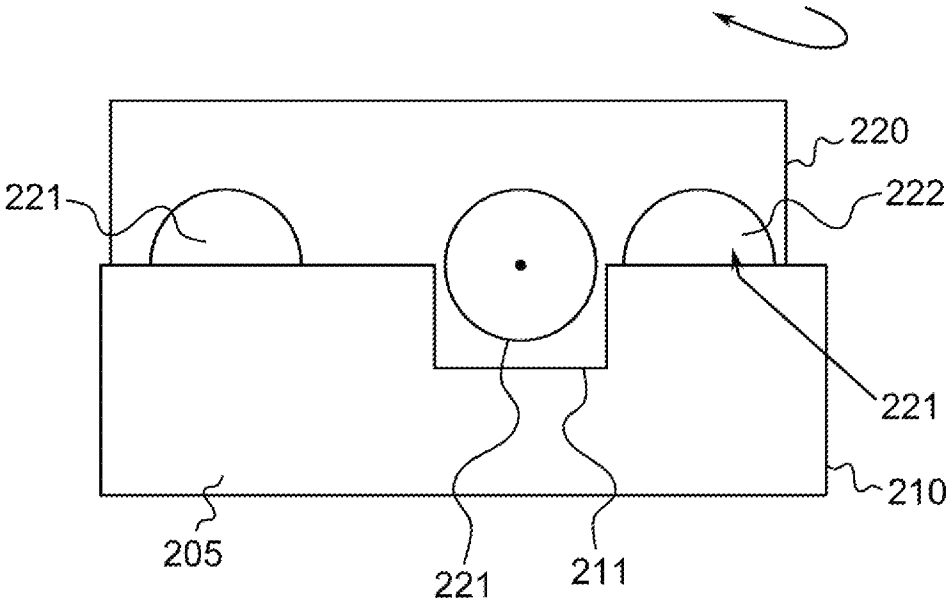
FIG. 5 is an exemplary depiction of the tray of FIG. 4 in deformed shape.

FIG. 5 shows a further lateral surface 205 of the tray of FIG. 4, wherein the tray 200 is shown in deformed state and after rotating the rotatable portion 220 such that the opening of one of the cavities is positioned where its content can be accessed.

The deformed state can be achieved by pressure (or force) on the lateral surfaces 202, 203 of the tray 200. Hence, for achieving deformation with a single hand, the hand span must be large enough as specified above. Otherwise, two hands are required for applying sufficient pressure (or force) on the lateral surfaces 202, 103 of the tray 200 such that the tray 200 becomes deformed. Once pressure is released, the tray 200 immediately returns back into the default state, e.g. the tray 200 snaps back into the default state. In an embodiment, deforming requires a pressure exceeding a predetermined pressure threshold specified above or a predetermined force specified above.

Simultaneous pressure on the lateral surfaces 202, 203 causes the rotatable portion 220 to be lifted with respect to the outer portion 210 such that the cylindrical surface 222 becomes visible. Though lifted, all of the openings 221 of the cavities 201 are still partly covered by the lateral surface 205 of outer portion 210. By means of appropriate rotation, the opening of one the cavities may be aligned with an indentation 211. The indentation 211 is formed such that it allows access to content of a cavity having its opening aligned with the indentation 211.

The further lateral surface 205 has an indentation 211 arranged corresponding to the openings 221 such that, by rotating the rotatable portion 220, one of the openings 221 can be aligned with the indentation 211 and the e-cigarette's portion contained in the respective cavity 201 becomes accessible. According to embodiments of the present invention, the objects (electronic smoking device or a part of the electronic smoking device) may be fixed in the cavities 201 such that they can only be taken out with another device (e.g. battery 18).

Since rotation is only possible while simultaneous pressure is applied, both hands are required simultaneously for taking out the functional components of an electronic smoking device such as a cartomizer, a liquid reservoir, an atomizer/liquid reservoir portion or a mouthpiece portion. Therefore, only an adult can do so but a child or teenager cannot apply sufficient pressure with a single hand therefore not having a free hand for doing the rotation even if capable of applying sufficient simultaneous pressure with both hands.

The tray 200 may be a plastic container, for instance a thermoformed plastic container. In another exemplary and non-limiting embodiment the tray 200 is injection molded.

Figure 6:
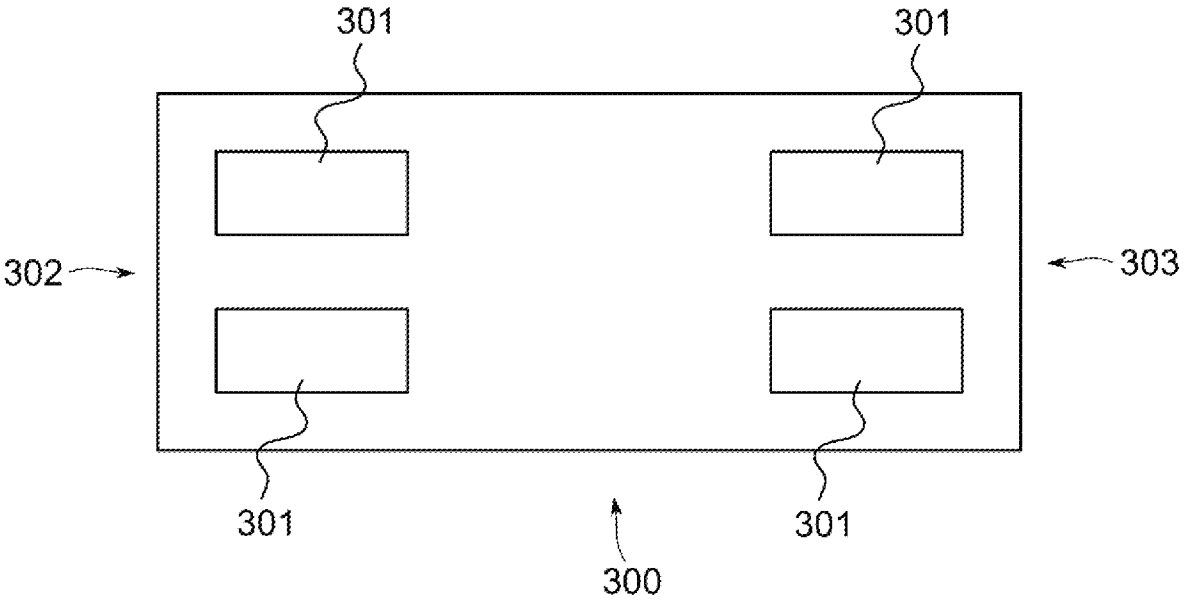
FIG. 6 is an exemplary depiction of a tray according to a third embodiment of the present invention.

FIG. 6 shows an exemplary depiction of a tray 300 according to a third embodiment of the present invention. An example of a top surface of the tray 200 is depicted in FIG. 6 in its undeformed state.

The tray 300 depicted in FIG. 6 comprises separate cavities 301, each for containing a portion of an electronic smoking device, e.g., cartomizers. In other exemplary embodiments, the cavities 301 can be configured for containing mouthpieces, atomizer/liquid portions and/or liquid reservoirs.

The tray 300 surrounds the portions in a manner that no finger can be put between the portions and the tray 300 when the tray is in the undeformed state. Hence, also portions of the e-cigarette 10 contained or accommodated in the cavities 301 of the tray 300 cannot be accessed either by a child or by an adult when the tray 300 is in the undeformed state. Lid portions of the tray 300 cover openings of the cavities 301 in the undeformed state.

Figure 7:
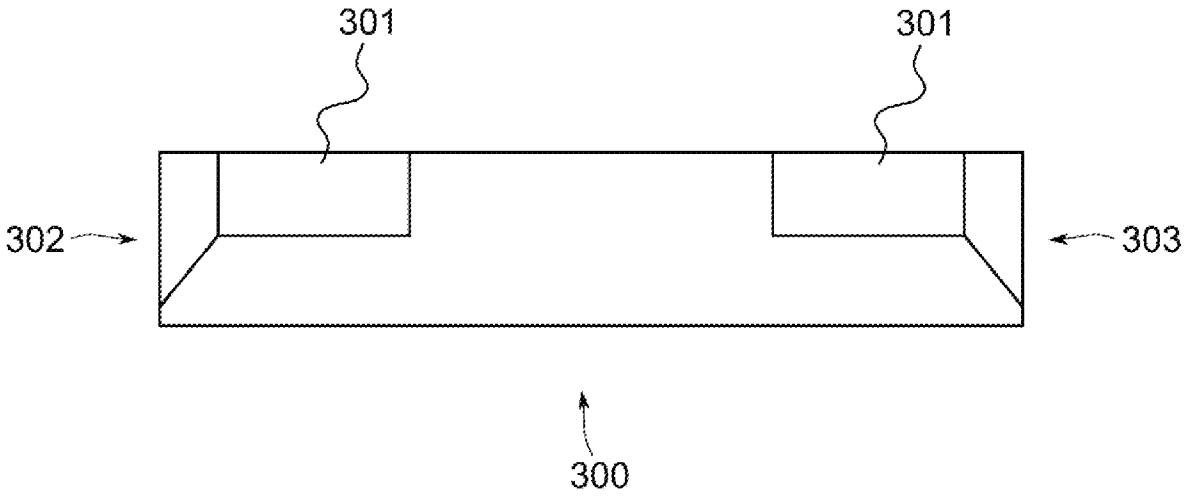
FIG. 7 is an exemplary depiction of the tray of FIG. 5 in deformed shape.

FIG. 7 shows a lateral surface of an embodiment of the tray of FIG. 6 in deformed state. The deformed state can be achieved by pressure (or force) on the further lateral surfaces 302, 303 of the tray 300. The further lateral surfaces 302, 303 have a distance to each other as specified in connection with the other embodiments. That is, a user's hand must be sufficiently large for appropriately operating the tray of the present invention, i.e. for unlocking and removing the electronic smoking device (or a part thereof). Otherwise, two hands are required for applying sufficient pressure (or force) on the further lateral surfaces 302, 303 of the tray 300 such that the tray becomes deformed. Once pressure is released, the tray 300 returns immediately back to the default state, e.g. the tray may snap back into the default state. In an embodiment, deforming requires a pressure exceeding a predetermined pressure threshold (or force) as specified in connection with the other embodiments.

In the deformed state, the lid portions are flapped away from the openings such that portions of an electronic cigarette contained in the options become accessible. In some embodiments, the access is restricted to use of a further portion of the electronic smoking device. That is, in some embodiments the portions still cannot be taken out by hand even if the tray is in the deformed state. Instead, the further portion may be fit to the portion in the cavity, for example by a friction push fit, a snap fit, or a bayonet attachment, magnetic fit, or screw threads.

Figure 8:
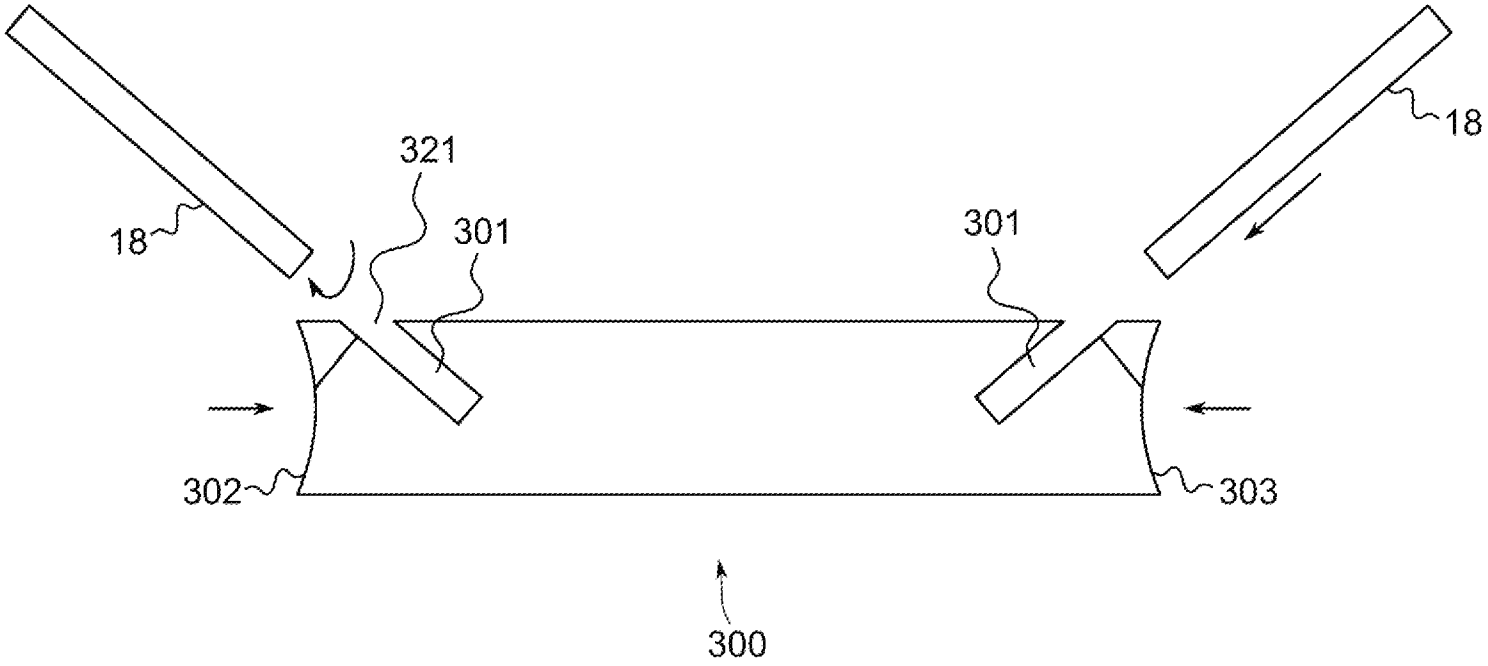
FIG. 8 is an exemplary depiction of another embodiment of the tray of FIG. 6 in deformed shape.

FIG. 8 shows a lateral surface of another embodiment of the tray of FIG. 6 in deformed state. Due to pressure on the further lateral surfaces 302, 303 of the tray 300, the cavities 301 and the parts of the electronic smoking device accommodated therein move upwards thereby becoming accessible. According to embodiments of the present invention, the objects (electronic smoking device or a part of the electronic smoking device) may be fixed in the cavities 301 such that they can only be taken out with another device (e.g. battery 18).

The tray 300 may be a plastic container, for instance a thermoformed plastic container. In another exemplary and non-limiting embodiment the tray 300 is injection molded.

Figure 9:
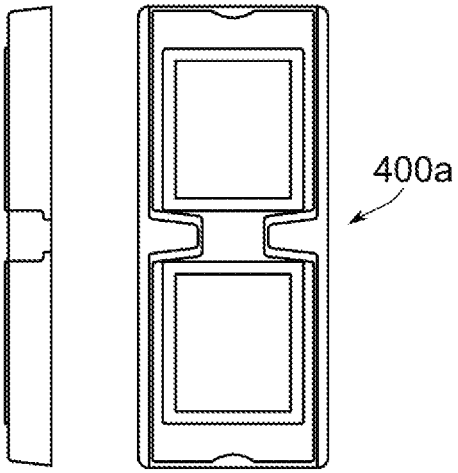
FIG. 9 a first part of an exemplary two-part embodiment of the present invention.
Figure 10:
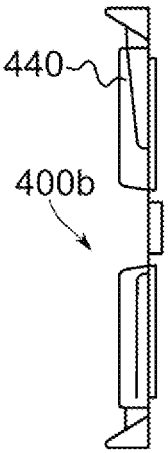
FIG. 10 a second part of the exemplary two-part embodiment of the present invention.
Figure 11:
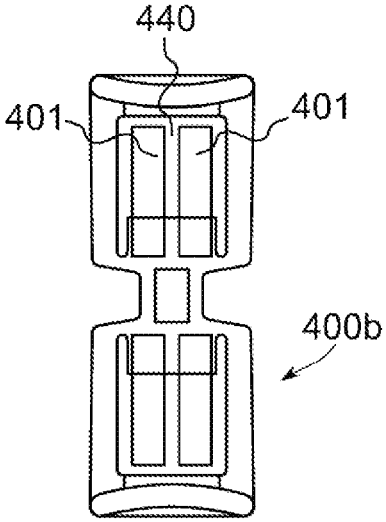
FIG. 11 the second part of the exemplary two-part embodiment of the present invention from a different perspective.

FIG. 9 shows a first, rectangular shaped part 400*a* of an exemplary two-part embodiment of the present invention and FIGS. 10 and 11 show a second part 400*b* of the exemplary two-part embodiment of the present invention from different perspectives. The second part 400*b* shown in FIGS. 10 and 11 is also shaped rectangular but with indentations 430 on the long sides. This embodiment is configured for accommodating two portions, e.g. cartomizers, of an electronic smoking device or two electronic smoking devices in a child-safe manner in two cavities 401 extending parallel to each other and the long sides. The second part 400*b* comprises, between one pair of same-side ends of the two cavities 401, an inclining centre part 440, half way up, to grip ends of the cartomizers but allow access of middle parts of the cartomizers when being deformed in a deformed shape. Deformability is supported by a web across the second part parallel to the short sides of the second part. The second part 400*b* can be fitted onto the first part 400*a* thereby forming the exemplary two-part embodiment of the present invention.

Figure 12:
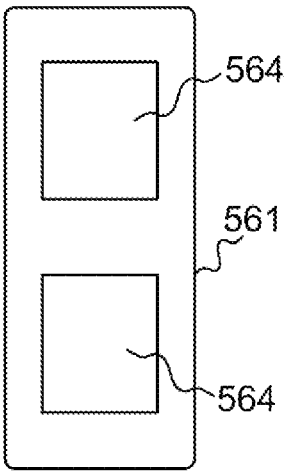
FIGS. 12-14 cutters of the exemplary two-part embodiment of the present invention
Figure 13:
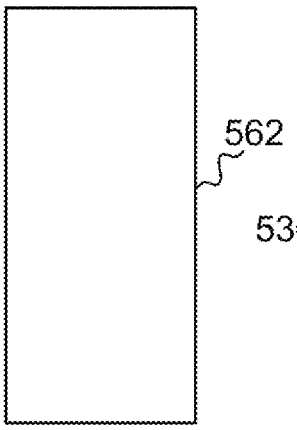
Figure 14:
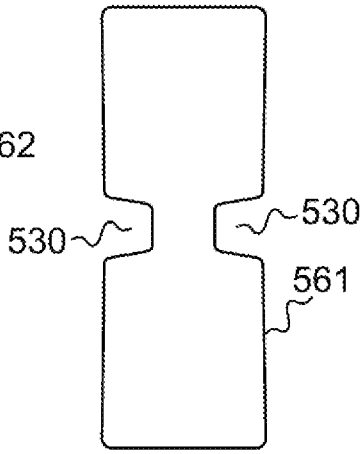

FIGS. 12-14 show cutters 561, 562, 563 of the exemplary two-part embodiment of the present invention. Exemplarily, a first cutter 561 may have a rectangular shape with two square-like openings 564 and a length of 120 to 130 mm, exemplarily 127 mm as shown in FIG. 11, and a width of 45 to 55 mm, exemplarily 52 mm as shown in FIG. 11. Exemplarily, a second cutter 562 may have a rectangular shape with a length of 110 to 120 mm, exemplarily 115 mm as shown in FIG. 12, and a width of 45 to 55 mm, exemplarily 52 mm as shown in FIG. 12. Exemplarily, a third cutter 563 may have a rectangular shape having indentations 530 centered on the longer sides with a length of 120 to 130 mm, exemplarily 122 mm as shown in FIG. 13, and a width of 40 to 50 mm, exemplarily 45 mm as shown in FIG. 13.

In an exemplary embodiment of a first aspect of the invention there is a tray for containing at least a portion of an electronic smoking device in a child-safe manner. The tray comprises at least one cavity for containing the portion.

The tray is configured to be reversibly deformed from a default form into a deformed form by finger interaction with interaction elements of the tray having a distance to each other of at least 90% of the average distance between thumb tip and index finger tip or a middle finger tip of an adult.

The tray is configured to return to the default form once the finger interaction is terminated. The default form provides the at least one cavity for containing the portion in an inaccessible manner and the deformed form being required for accessing the portion.

The interaction elements may be located on opposite surfaces of the tray.

The finger interaction may comprise applying pressure on the interaction elements.

The pressure required for deforming the tray into the deformed form may be at least 90% of the pressure which an average adult can apply on the interaction elements using the thumb tip and the index finger tip or the middle finger tip.

By deforming the tray, an opening in the tray of the cavity may be opened to a width allowing the portion to be accessed and taken out.

By deforming the tray, the portion may be further moved, at least partly, through the opening.

The tray may comprise a rotatable portion providing the cavity. In the default form, the rotatable portion may be inaccessible for rotation by hand and/or may be blocked from being rotated. In the deformed form, the rotatable portion may be accessible for rotation. Rotation may be required of the rotatable portion in the deformed form for accessing the portion.

Rotation may be required of the rotatable portion in the deformed form a starting point to a predetermined point for accessing the portion.

Before the finger interaction is terminated for the tray returning into the default form, counter-rotation in the deformed form to the starting point may be required.

The cavity may be configured for containing an electronic smoking device.

The portion may be a mouthpiece portion, a liquid reservoir portion, a cartomizer or an atomizer/liquid reservoir portion.

The tray may comprise multiple cavities.

An advantage of certain embodiments may be that child-safe containment of electronic smoking devices and/or associated portions can be achieved.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10 electronic smoking device
12 battery portion
14 atomizer/liquid reservoir portion
16 end cap
18 battery
20 light-emitting diode (LED)
22 control electronics
24 airflow sensor
26 atomizer
28 heating coil
30 wick
32 central passage
34 liquid reservoir
36 air inhalation port
38 air inlets
100, 200, 300 tray
400*a*, first part of tray
400*b* second part of tray
101, 201, 301, 401 cavity
102, 202, 302 lateral surface
103, 203, 303 lateral surface
110, 210 outer portion
111 part of pouter portion
120 inner portion
130, 430, 530 indentation
440 inclining centre part
205 further lateral surface
211 indentation
220 rotatable portion
221, 321 opening

222 cylindrical surface
561, 562, 563 Cutters
564 square-like opening

The invention claimed is:

1. A tray adapted for accommodating at least a portion of an electronic smoking device in a child-safe manner, the tray comprising at least one cavity adapted for accommodating said electronic smoking device or said portion of the electronic smoking device, wherein the tray is configured to be reversibly deformed from an undeformed shape into a deformed shape by simultaneous finger interaction of a user with at least two interaction elements of the tray, and wherein the tray comprises a rotatable portion configured to be rotated around a normal of a top surface of the tray, wherein, in the undeformed shape, the rotatable portion is inaccessible for rotation by a hand of a user, wherein, in the deformed shape, the rotatable portion is accessible for rotation, and wherein the rotatable portion is configured to be rotatable in the deformed shape for accessing said electronic smoking device or said portion of the electronic smoking device.

2. The tray according to claim 1, wherein the at least two interaction elements are located on opposite surfaces of the tray.

3. The try according to claim 1, wherein the at least two interaction elements are spaced apart from each other at a distance of at least 6 cm.

4. The tray according to claim 1, wherein the finger interaction comprises applying pressure on the interaction elements.

5. The tray according to claim 4, wherein the pressure required for deforming the tray into the deformed shape is at least 90% of the pressure which an average adult can apply on the interaction elements using a thumb tip and an index finger tip or a middle finger tip.

6. The tray according to claim 1, wherein the undeformed shape is configured such that the at least one cavity locks said electronic smoking device or said portion of the electronic smoking device to the tray.

7. The tray according to claim 1, wherein the deformed shape is configured such that the at least one cavity unlocks said electronic smoking device or said portion of the electronic smoking device from the tray.

8. The tray according to claim 1, wherein the at least one cavity is configured such that, by deforming the tray, an opening is opened in the tray of the cavity having a width such that said electronic smoking device or said portion of the electronic smoking device is unlocked from the tray.

9. The tray according to claim 8, wherein the at least one cavity is configured such that, by deforming the tray, said electronic smoking device or said portion of the electronic smoking device is further moved, at least partly, through the opening.

10. The tray according to claim 1, wherein the tray is configured to return to the undeformed shape once the finger interaction is terminated.

11. The tray according to claim 10, wherein the rotatable portion has to be rotated in the deformed shape from a starting point to a predetermined point for accessing the said electronic smoking device or said portion of the electronic smoking device.

12. The tray according to claim 11, wherein, for the tray returning into the undeformed shape, the rotatable portion has to be rotated in the deformed shape to the starting point before the finger interaction is terminated.

13. The tray according to claim 1, wherein the cavity is configured for accommodating an electronic smoking device.

14. The tray according to claim 1, wherein said portion of the electronic smoking device is a mouthpiece portion, a liquid reservoir portion, a cartomizer or an atomizer/liquid reservoir portion.

15. The tray according to claim 1, wherein the tray comprises a plurality of cavities.

* * * * *